US009055817B2

(12) United States Patent
Weber et al.

(10) Patent No.: US 9,055,817 B2
(45) Date of Patent: Jun. 16, 2015

(54) SEATING FURNITURE WITH INDEPENDENTLY FREE-SWINGING SEAT AND BACKREST

(75) Inventors: Reinhard Weber, Minden (DE); Walter Richter, Tauberbischofsheim (DE); Markus Schuppler, Tauberbischofsheim (DE)

(73) Assignee: VS Vereinigte Spezialmobelfabriken GmbH & Co. KG, Tauberbischofsheim (DE)

( * ) Notice: Subject to any disclaimer, the term of this patent is extended or adjusted under 35 U.S.C. 154(b) by 702 days.

(21) Appl. No.: 13/328,137

(22) Filed: Dec. 16, 2011

(65) Prior Publication Data

US 2012/0153700 A1 Jun. 21, 2012

(30) Foreign Application Priority Data

Dec. 17, 2010 (DE) ..... 10 2010 054 887

(51) Int. Cl.
*A47C 3/023* (2006.01)
*A47C 7/44* (2006.01)

(52) U.S. Cl.
CPC ..... *A47C 3/023* (2013.01); *A47C 7/443* (2013.01)

(58) Field of Classification Search
USPC ..... 297/445.1, 446.1, 446.2, 447.1, 447.2, 297/448.1, 448.2, 451.3, 451.7
See application file for complete search history.

(56) References Cited

U.S. PATENT DOCUMENTS 149,845 A * 4/1874 Sebel ..... 366/170.1
3,711,156 A * 1/1973 Bloomfield ..... 297/452.13
4,522,444 A 6/1985 Pollock
4,618,185 A * 10/1986 Kaufman ..... 297/285
4,787,672 A 11/1988 Werner
5,649,739 A * 7/1997 Zapf ..... 297/301.1
6,837,539 B1 * 1/2005 Casey ..... 297/162
2003/0090139 A1 5/2003 Kown
2004/0251729 A1 12/2004 Olson
2005/0264083 A1 12/2005 Ambasz

FOREIGN PATENT DOCUMENTS

DE 4135488 A1 4/1993
DE 29718785 U1 12/1997
DE 100 16 359 A1 10/2001

(Continued)

OTHER PUBLICATIONS

European Search Report, European Patent Application No. 11009744.1, Apr. 2, 2012, 7 pages.

*Primary Examiner* — David R Dunn
*Assistant Examiner* — Timothy J Brindley
(74) *Attorney, Agent, or Firm* — Stoel Rives LLP

(57) ABSTRACT

An article of furniture, such as a chair, including a free-swinging seat and a free-swinging backrest. The chair includes a seat and backrest coupled to a chair frame, where the chair frame includes first and second laterally spaced apart components. The first and second components each have a floor strut and a pair of legs that may be arranged in a substantially triangular configuration for supporting the seat. The chair also includes a coupling device, which may include a spring element, coupled to the legs and configured to allow forward movement of the seat and backward movement of the backrest, where movement of the seat and backrest may occur independently of one another. In some embodiments, the maximum movement of the seat and backrest may be limited by restricting movement of the coupling device.

18 Claims, 3 Drawing Sheets

(56) References Cited

FOREIGN PATENT DOCUMENTS

| | | | |
|---|---|---|---|
| DE | 10 2007 052 937 | A1 | 5/2009 |
| EP | 1 600 083 | A1 | 11/2005 |
| FR | 1350571 | | 1/1964 |
| WO | WO 2010/114527 | A1 | 10/2010 |

* cited by examiner

SEATING FURNITURE WITH INDEPENDENTLY FREE-SWINGING SEAT AND BACKREST

RELATED APPLICATIONS

This application claims the benefit under 35 U.S.C. §119 of German Utility Model Application No. DE 10 2010 054 887.1, filed Dec. 17, 2010, which is hereby incorporated by reference in its entirety.

TECHNICAL FIELD

The field of the disclosure generally relates to seating furniture, in particular, seating furniture having a free-swinging seat and a free-swinging backrest.

BACKGROUND

U.S. Pat. No. 4,787,672 of Werner describes a free-swinging chair having an angular seating portion having a seat and a backrest, both configured as one common component. A chair frame for supporting the seating portion has two lateral components having a tubular profile that is bent into an almost Z-type shape to achieve a spring-like effect. To avoid an excess swinging and/or rocking action of the chair, a bar-shaped reinforcement member is disposed on both lateral components, connecting the two end sections of the respective Z-shaped components. In this configuration, any excess sizing of the bent tubular profile can be avoided which, aside from an increase in weight, would also reduce the spring action.

German App. No. DE 41 35 488 A1 of Landgraf describes one means for avoiding excess sizing of the bent tubular profile. For example, Landgraf proposes inserting reinforcement members into the tubular profile before the bending process, which are then subsequently deformed together with the tubular profile and thus contribute to a reinforcement of the profile. However, a reinforcement of this kind runs counter to a desired spring action.

German App. No. DE 297 18 785 U1 of Erhard discloses a chair construction with an immobile seating area and a free-swinging backrest that swings independently of the seating area. The chair frame is constructed of square-steel-bar tubing including two arc-type constructs for holding the backrest in the bottom area of the base points and in the upper area of the backrest.

Accordingly, the present inventors have identified a need for seating furniture having a frame and a free-swinging seat and backrest, where both the seat and backrest swing freely and independently of each other. In addition, the present inventors have identified a need for such a seating furniture that helps avoid excess sizing of the frame.

SUMMARY

An article of seating furniture, such as a chair, including a seat, a backrest, and a chair frame. As used herein, the seat defines a main seating direction extending from a rear side of the seat to a front side of the seat. The chair frame includes two laterally spaced apart components, where each of the components includes: a floor strut having opposing front and rear ends, the floor strut arranged in a substantially horizontal orientation parallel to the seating direction; a first leg having opposing upper and lower ends, wherein the lower end adjoins to the rear end of the floor strut, and wherein the first leg extends vertically and in an angular orientation from the rear end of the floor strut; a first fastener disposed on the upper end of the first leg and configured to be coupled to the seat; a second leg having opposing upper and lower ends, wherein the lower end adjoins to the front end of the floor strut, and wherein the second leg extends vertically and in an angular orientation from the front end of the floor strut; and a second fastener disposed on the upper end of the second leg and configured to be coupled to the seat, wherein the upper end of the first leg is proximal to the front side of the seat and the upper end of the second leg is proximal to the rear side of the seat. In addition, the article includes a longitudinally changeable coupling device connected on a first end via at least one first connection site with the first leg and on a second end via at least one second connection site with the second leg, wherein the coupling device is configured in such a way that its maximum length is limited.

In one embodiment, the seat and the backrest of the seating furniture are configured as separate components that are separately fastened to the first and/or second legs of the chair. In such a configuration, it is possible for the seat and the backrest to have the ability of swinging freely and independently of each other. Alternatively, the seat and the backrest can also be configured as a single, unitary component or as separate components connected to each other. In such embodiments, the seat and backrest unit are movably coupled to each other so as to provide a free swinging action of the seat and backrest unit.

In some embodiments, the floor struts and the two legs of each laterally spaced apart component are arranged in a substantially triangular configuration. In such embodiments, bending moments occur mainly in connecting areas between the floor struts and the first and/or second leg (s) inside the chair frame. In particular, in the front, the seat is able to swing downward by the first legs bending forward in the area of the rear end section and the backrest is able to swing rearward by the second legs bending to the rear in the area of the front end section of the floor strut. The floor struts each extend substantially horizontally and are substantially parallel in relation to the floor on which the seating furniture is located. The floor struts can lie directly on the floor, or can be arranged at a distance from the floor supported by base elements and/or base gliding elements. In some embodiments, the floor struts may be connected to each other by at least one cross-member to improve the stability of the chair frame.

In some embodiments, the first legs and the second legs of the chair frame extend, respectively, from the rear and/or front end section of the floor strut. The connection therein can be configured as angular or bent. The angle between the floor strut and the two legs is, as a matter of principle, freely selectable and can be selected as different or identical for the first and second legs in relation to each other. In some embodiments, the two lateral components of the chair frame are configured and disposed in a substantially symmetrical configuration in relation to the main seating direction. In addition, the floor struts may extend essentially parallel in relation to the main seating direction, or may be in an angular orientation having an angular range of approximately plus or minus 15 degrees in relation to the main seating direction to increase the stability of the chair frame and thereby of the entire piece of seating furniture.

In some embodiments, the connection area between the floor struts and the legs, are constructed from a single, unitary component to absorb the bending moments at that location. Alternatively, the floor struts and legs can optionally be configured in one or in multiple pieces. In other embodiments, the first leg is spaced apart from the second leg by a minimum distance of 25 millimeters to ensure that there are no nips on the seating furniture that may cause injury to users as the chair swings back and forth.

In some embodiments, the upper end sections of the first legs are positioned in front of the upper end sections of the second legs, meaning the first legs of the chair frame intersect with the second legs, thus allowing the seat to be mounted in front of the back rest at the first fastening section of the first legs. The first legs of the chair frame therein can extend diagonally relative to the main seating direction, optionally inside or outside of the chair frame. Furthermore, the upper end sections of the first legs may be at least, in part, taken up in the seat, meaning the underside of the seat. In some embodiments, the first fastening section may extend essentially horizontally to provide easier mounting and alignment of the seat on the first fastening section. In other embodiments, the fastening sections of each of the two lateral components of the chair frame may be connected to each other to improve the stability of the chair frame and seating furniture.

In such embodiments, at least one first connecting site of the coupling device may be disposed and arranged in the connection area, which allows for the at least a first connection site to be positioned as closely as possible in relation to the center axis of the seating furniture in the main seating direction and provides a stable and central connection of the first and second legs.

In some embodiments, the seating furniture includes a longitudinally changeable coupling device configured and operable to prevent excess swinging and/or rocking of the seat and the backrest. This coupling device connects the two legs of the lateral components of the chair frame in such a way that the seat is prevented from moving too far away from the backrest.

In some embodiments, the coupling device may be structurally sound such that additional, stronger sizing of the chair frame, which would counteract the free swinging action and also result in a higher weight, is unnecessary. By limiting the free swinging motion of the seat and/or the backrest, the bending moments acting at the bent connections between the floor strut and the respective leg are also limited, whereby the material stresses on the chair frame are also reduced.

In some embodiments, the coupling device has at least one connection site with the first legs of the lateral parts of the chair frame as well as at least one second connection site with the second legs of the lateral parts of the chair frame, meaning the coupling device may include one or more coupling lines that correspondingly require one or several first and/or second connection sites with the legs of the chair frame. The number of first and second connecting sites of the coupling device on the first and second legs, respectively, can optionally be identical or different in relation to each other. In embodiments having two or more coupling lines, the coupling lines may be disposed and/or configured symmetrically with regard to the main seating direction.

In some embodiments, the coupling device is configured and/or disposed in such a way that its connecting direction is substantially parallel in relation to the main seating direction. Alternatively, the coupling device may be angularly aligned in relation to the main seating direction. In embodiments having more than one coupling line, in particular, at least a portion of the coupling lines may be oriented at an angle relative to the main seating direction. The totality of the coupling lines may be configured and disposed symmetrically in relation to the main seating direction, resulting overall in a coupling device with a direction of action in the main seating direction.

The coupling device may be configured and/or disposed in such a way that its connecting direction extends essentially horizontally. In this embodiment, the coupling device may be disposed in very close vicinity to the seat and take up minimal space. In such configurations, the seating furniture may be arranged on a table without the coupling device interfering with the suspension action or becoming damaged due to the suspension action. Alternatively, the coupling device can also be configured and/or disposed in such a way that its connecting direction extends essentially vertically and angularly in relation to the horizontal line. In some embodiments, the coupling device may be taken up at least, in part, in the seat, more specifically in the underside of the seat for additional protection. In other embodiments, the coupling device may be positioned completely underneath the seat.

In some embodiments, the length of the coupling device can be changed between the first and the second legs of the two lateral components of the chair frame and it may be configured to have a limited maximum length. The coupling device may connect the first and second legs of two lateral components with each other and allow—starting with a relaxed resting position of the seating furniture and/or the chair frame (e.g., without any load acting on the piece of seating furniture, for example due to a person sitting thereon)—for a widening of the distance between the first and second connecting sites on the first and/or second legs ("longitudinally changeable") to the point of a preset maximum distance. Naturally, this applies for the intended use of the seating furniture involving the related typically occurring forces and weights. The disclosure comprises coupling devices that counteract this distance change with a force, as well as coupling devices that freely allow this distance change (to the maximum distance).

In some embodiments, the at least one connecting site of the coupling device is arranged with the first legs of the chair frame in front of and/or above the at least one second connecting site of the coupling device with the second legs of the chair frame. In this positioning of the coupling device, the longitudinal limitation of the coupling device may limit the movement of the seat and/or the backrest.

In some embodiments, the coupling device includes at least one elastic spring element, such as a helical tension spring. In such embodiments, the elastic spring element may dampen the motion of the seat and/or backrest and/or counteract it by the force created by the spring element.

In other embodiments, the coupling device may include at least one rope, which may comprise a steel rope, on which at least one end is equipped with a stop element. While the seating furniture and/or the chair frame is in a resting state, this rope may be loosely routed between the first and the second connection sites. In addition, when the seating furniture and/or chair frame experiences a load, the rope, via the stop element, delimits the length of the coupling device and thereby the distance between the first and second legs of the lateral parts.

In other embodiments, the coupling device may include, in the alternative or in addition to the at least one elastic spring element, at least two rigid elements that engage with each other and are movable in relation to each other. The two rigid elements may be bolts that are guided inside corresponding oblong holes.

In some embodiments, the maximum length of the coupling device may be variably adjustable to provide for adjustment depending on, for example, expected load (such as for a child, adolescent, adult) without having to change or switch out the coupling device. In other embodiments, the chair may be provided with a set of multiple coupling devices (e.g. one for a child, one for an adolescent, and for an adult) that are easily interchangeable depending on the intended use of the chair. In yet another embodiment, the coupling device may be configured in such a way that its minimum length is limited and/or variably adjusted as well. Depending on the coupling device between the two legs of the lateral part of the chair frame, such a minimum length of the coupling device may restrict the motion of the seat and/or backrest.

Additional aspects and advantages will be apparent from the following detailed description of preferred embodiments, which proceeds with reference to the accompanying drawings.

DETAILED DESCRIPTION OF PREFERRED EMBODIMENTS

Figure 1:
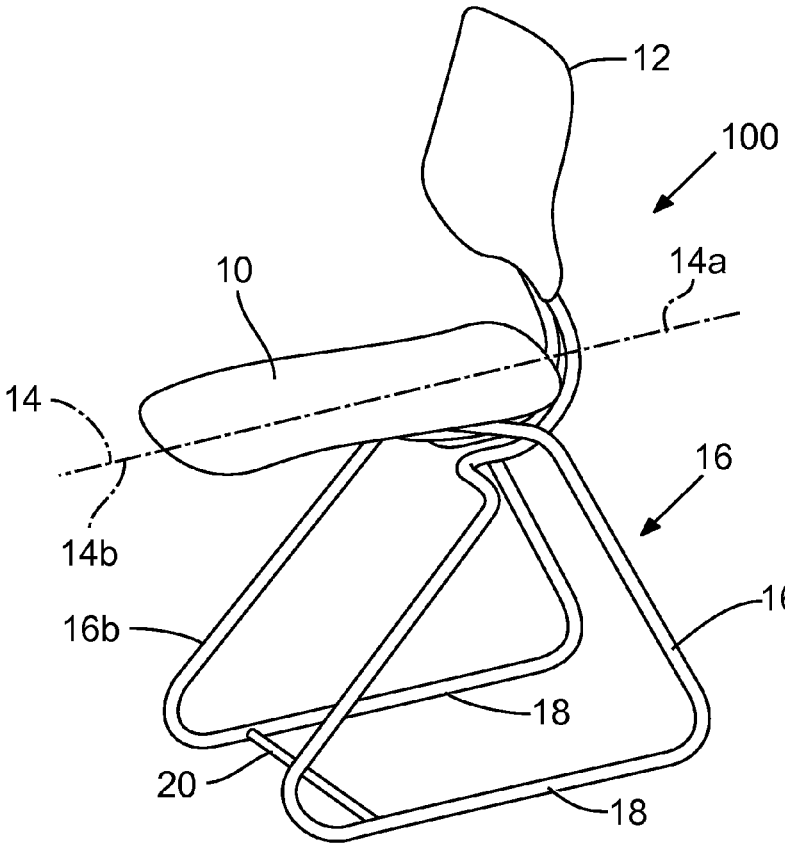
FIG. 1 is a perspective view of an article of seating furniture, according to one embodiment.

With reference to the drawings, this section describes particular embodiments and their detailed construction and operation. The embodiments described herein are set forth by way of illustration only and not limitation. The described features, structures, and characteristics may be combined in any suitable manner in one or more embodiments. In view of the disclosure herein, those skilled in the art will recognize that the various embodiments can be practiced without one or more of the specific details or with other methods, components, materials, or the like. For the sake of clarity and conciseness, certain aspects of components are presented without undue detail where such detail would be apparent to those skilled in the art in light of the teachings herein and/or where such detail would obfuscate an understanding of more pertinent aspects of the embodiments.

FIGS. 1-4 illustrates an embodiment of an article of seating furniture, such as a chair 100, having a coupling device for providing independent free-swinging motion for a seat and a backrest of the seating furniture. For convenience, the following description of the seating furniture 100 uses a chair as an example of the seating furniture 100. It should be understood that the description specifically identifying a chair is for illustration purposes only and not meant to limit the seating furniture to a chair. With reference to FIGS. 1-4, the chair 100 includes a seat 10 and a backrest 12. The seat 10 and the backrest 12 may comprise separate structures coupled or connected together by a supporting structure in an angular relationship as desired to provide a comfortable and/or ergonomic seating position. In other embodiments, the seat 10 and the backrest 12 may be constructed from a single, unitary component.

The chair 100 and all of its components may be constructed from any suitable materials. For example, the seat 10 and the backrest 12 may be constructed from plastic or wood. In some embodiments, the seat 10 and/or backrest 12 may include a fabric or cushioned covering to provide additional comfort. In other embodiments, the chair 100 and its components may be constructed from other materials, which may depend on various factors such as weight, cost, durability, and availability of materials. Moreover, the shape, size and material of the seat 10 and the backrest 12 may be selectable by the manufacturer, or by the end consumer, or may be made of standard sizes, shape, and materials common in the industry.

The seat 10 defines a main seating direction 14 that extends from a generally rear side 14*a* to a generally front side 14*b* of the chair 100. In the figures, the main seating direction 14 is marked, respectively, at a central axis of the chair 100. The main seating direction 14 results from normal use of the piece of seating furniture in a straight upright sitting position in which the user is seated in the chair 10 at any given time, supported in the back via the backrest 12 and with the gaze straight ahead to the front.

The seat 10 and backrest 12 are fastened or coupled to a chair frame 16. The chair frame 16 includes two laterally spaced apart components or parts, 16*a*, 16*b*, configured and disposed symmetrically in relation to the center axis of the chair 100 in the main seating direction 14. In some embodiments, the chair frame 16 and the two components 16*a*, 16*b* may be constructed of a rigid metal or metal alloy material, such as high-tenacity steel or other structurally stable materials.

Each of the two lateral components 16*a*, 16*b*, include a floor strut 18 that extends essentially horizontally (i.e., parallel to the floor). In such embodiment, the floor struts 18 are aligned parallel or substantially in relation with the main seating direction 14 (see FIG. 3). In some embodiments, the floor struts 18 may be arranged in an angular configuration in relation to the main seating direction 14, where the angle may range from approximately plus or minus 15 degrees. In other embodiments, foot elements, gliding elements or something structures (not shown) may be mounted on the floor struts 18. The floor struts 18 of each lateral component 16*a*, 16*b* may be connected to each other by a cross-member 20 extended therebetween.

Figure 2:
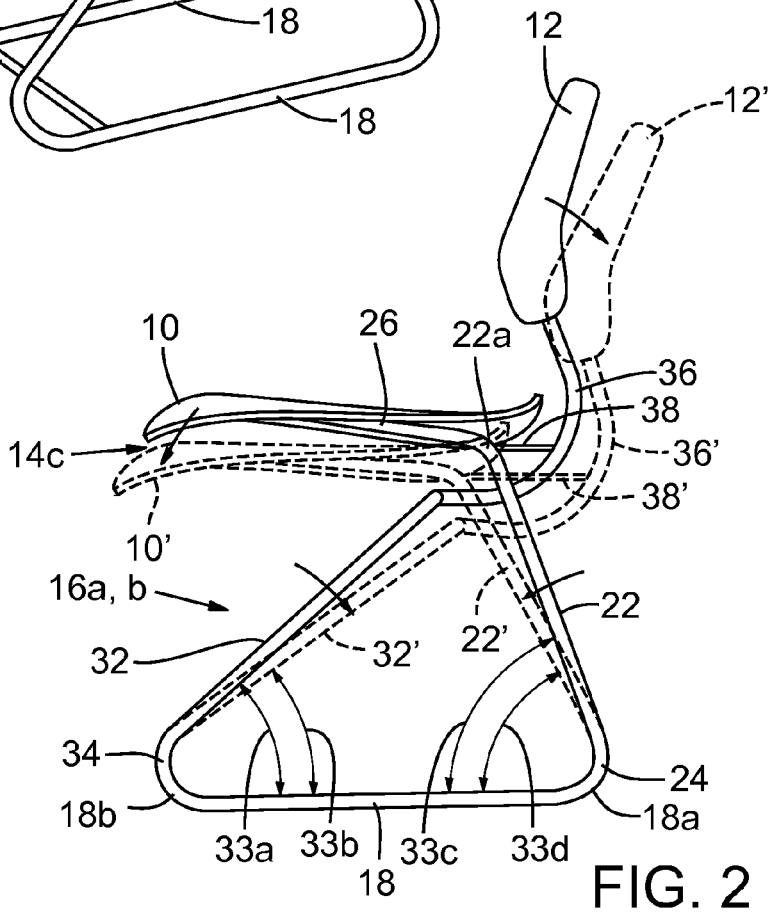
FIG. 2 is a side view of the seating furniture of FIG. 1 illustrating the seating furniture in an unloaded and loaded condition in phantom lines, according to one embodiment

Referring now to FIG. 2, each lateral part 16*a*, 16*b* further comprises a first leg 22 that extends at a first angle 33*c* and in a vertical direction from a rear end section 18*a* of the floor strut 18 and upward toward the seat 10. This first leg 22 may bend around the first connection area 24 between the floor strut 18 and the first leg 22 allowing the first leg 22 to swing freely to the front when the chair 100 experiences a load. The phantom lines in FIG. 2 illustrate the first leg 22' swinging forward in a loaded position and at a second angle 33*d* in relation to the floor strut 18.

The chair 100 further includes a first fastening section 26 (see FIGS. 2 and 3) on each lateral part 16*a*, 16*b*, where the fastening section 26 is disposed on an upper end section 22*a* of the first leg 22 that is directed away from the floor strut 18. The first fastening section 26 extends parallel or substantially parallel to strut 18 and may be connected to a second fastening section (i.e., on the mirror side of the chair 100) by a connection section 28 to increase the stability of the chair frame 16. A mounting plate 30 may be attached on the first fastening section 26 and connected, such as by a screw or other similar means, to an underside of the seat 10.

Moreover, each lateral part 16*a*, 16*b* includes a second leg 32 that extends at a third angle 33*a* and in a vertical direction from a rear end section 18*b* of the floor strut 18 and upward toward the seat 10. This second leg 32 bends around the front connection area 34 between the floor strut 18 and the second leg 32 allowing the second leg 32 to swing freely to the rear when the chair 100 experiences a load. The phantom lines in FIG. 2 illustrate the second leg 32' swinging backward in a loaded position and at a fourth angle 33*b* in relation to the floor strut 18.

A second fastening section 36 is disposed, respectively, on an upper end section of the second leg 32 that is directed away from the floor strut 18. These second fastening sections 36 may extend essentially horizontally toward the rear 14*a* (i.e., parallel or substantially parallel to the floor struts 18) of the chair 100, then upward in an arc. The backrest 12 may be fastened on the second fastening sections 36 of the second legs 32. In some embodiments, the second fastening sections 36 of the lateral parts 16*a*, 16*b* may be coupled to each other as well to further increase the stability of the chair frame 16.

Figure 3:
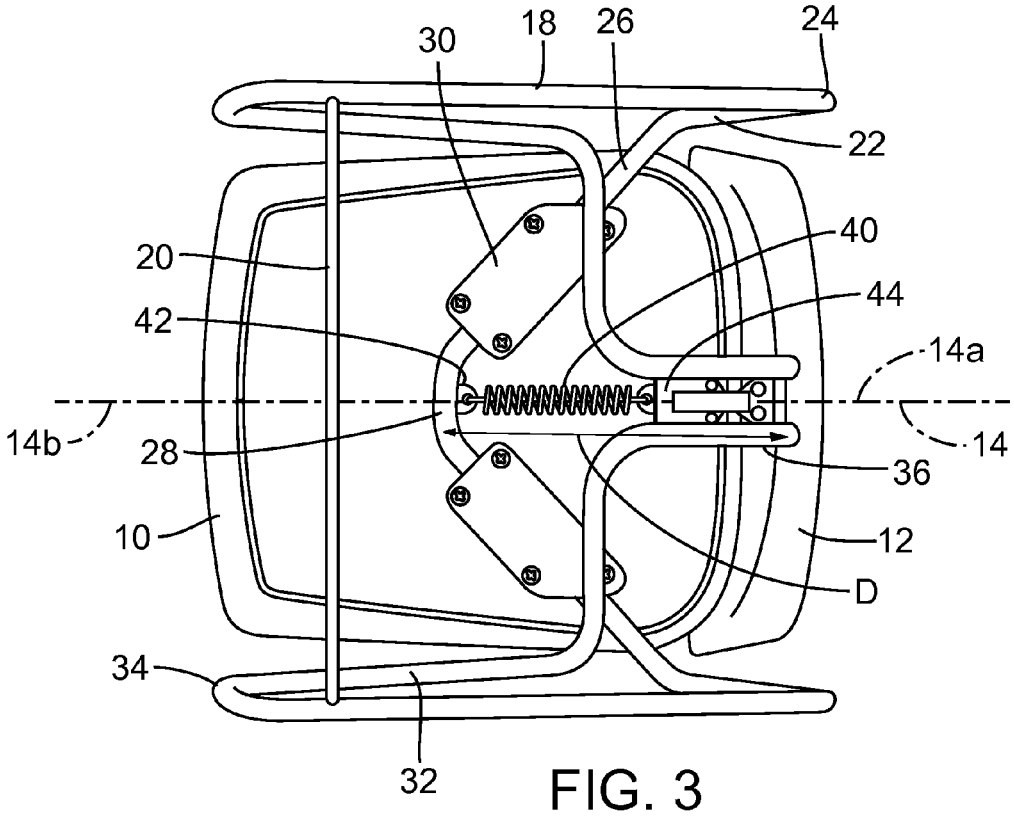
FIG. 3 is a bottom view of the seating furniture of FIG. 1 illustrating a couple device, according to one embodiment.

As illustrated in FIG. 2, the floor struts 18, the first leg 22, and the second leg 32 of each lateral part 16*a*, 16*b* form a substantially triangular shape. The first fastening sections 26 of the first legs 22 therein are positioned along the main seating direction 14, at least in part, in front of the second fastening sections 36 of the second leg 32. As illustrated in FIGS. 1 and 3, the first legs 22 that extend to the front are guided along the outside of the second legs 32 that extend toward the rear of the lateral parts 16*a*, 16*b*.

The chair frame 16 further includes a coupling device 38. As illustrated in FIG. 2, the coupling device 38 is, on one end, connected with the first fastening sections 26 of the first legs 22 and, on another end, with the second fastening sections 36 of the second legs 32 of the lateral parts 16*a*, 16*b*. The coupling device 38 thus extends essentially horizontally (i.e., parallel or substantially parallel to the floor struts 18 and may be in the same plane or a plane above or below a plane of the floor struts 18) between the two connection sites. As used herein, the connection site is defined as the connection between the coupling device 38 and the chair frame 16, whereas the first and second fastening sections 26, 36 are defined as the connection between the chair frame 16 and the seat 10 and/or backrest 12. For instance, the first fastening section 26 is configured to be coupled to the seat 10 and the second fastening section 36 is configured to be coupled to the backrest 12.

As shown in FIG. 2, a free space 14*c* is maintained below the seat 10, allowing for the chair to be, for example, suspended by the seat 10 on a table or other furniture. The coupling device 38 may also be, at least in part, integrated to the underside of the seat 10 for additional protection to the coupling device 38 and to reduce injury risk to the user and third parties. In some embodiments, the upper end sections 22*a* of the first legs 22 may also, at least in part, be integrated into the seat 10 to further improve the stability of the chair 100.

Referring now to FIG. 3, the coupling device 38 is attached such that it is substantially aligned along a center axis of the chair in the main seating direction 14. The coupling device 38 includes a spring element 40 that is fastened, via a first fastening element 42, to the connection section 28 of the first legs 22 and, via a second fastening element 44, with the two second fastening sections 36 of the second legs 32. In such configurations, the first connection site at the first fastening element 42 is positioned toward the front side 14*b* and the second connection site at the second fastening element 44 is positioned toward the rear side 14*a* relative to the main seating direction 14.

The spring element 40 of the coupling device 38 may counteract any excess distance D (see FIG. 3) between the upper end areas of the first and second legs 22, 32. The maximum distance therein may be limited by a maximum length of the spring element 40, and wherein this limitation is achieved by a dampening action during the stretching of the spring element 40 by the spring force ratios. If desired, the maximum length of the coupling device 38 can be adjusted for the respective user of the chair, such as to compensate for a user's body weight. This can be achieved, for example, by selecting a spring element 40 having an adjusted spring constant for the coupling device 38. In another embodiment, the second fastening element 44 of the coupling device 38 may be variably adjustable to increase or decrease length of the spring element 40. In other embodiments, the coupling device 38 may include two or more elastic spring elements 40 disposed in parallel or series relative to each other.

In one embodiment, the coupling device 38 may include two or more rigid components that movably engage with each other in order to specify a minimum and/or maximum length of the coupling device 38. For example, in one embodiment illustrated in FIG. 5, the chair 100 may include an oblong hole 62 formed in a first rigid component 60 (e.g., a plate) and extending in the main seating direction 14 with a bolt 66 formed at or fastened to a second rigid component 64 (e.g., a rod) that is movably guided therein and engaging the hole 62 to restrict the coupling device 38 once it has reached a maximum distance. In another embodiment, the features of the coupling device 38 illustrated in FIG. 5 may be combined with the features of the coupling device 38 in FIG. 4 by, for example, replacing the steel rope 50 or a combination of the steel rope 50 and spring element 40 with the rigid components 60, 64.

In example operation, the coupling device 38 may behave as follows (see FIG. 2). When a load is placed in the front side 14*b* of the seat 10, the coupling device 38 may extend to an extended position of the coupling device 38', and the seat 10 may tilt toward the front 14*b* to a second position of the seat 10', because the first legs 22 of the lateral parts 16*a*, 16*b* are able to swing forward around the rear connection areas 24 with the floor struts 18. However, this free swinging action of the chair 10 may be limited by the coupling device 38 that restricts the distance of the forward-moving first fastening sections 26 of the first legs 22 from the second fastening sections 36 of the second legs 32 that remain in their resting position. In this manner, excess swinging and/or rocking of the seat 10 toward the front side 14*b* may be limited, whereby any possible load application is also restricted to rear connection areas 24, which allows for selecting a smaller sizing of the tubular profile and/or additional stiffening of the tubular profile may be entirely omitted.

Similarly, the backrest 12 may rock toward the rear side 14*a* to a second position for the backrest 12' when the user places weight toward the rear side 14*a* and presses against the backrest 12, because the second legs 32 of the lateral parts 16*a*, 16*b* are able to swing around the front connection areas 34 with the floor struts 18 toward the rear side 14*a*. This free swinging action by the backrest 12 may be limited by the coupling device 38 that restricts the distance of the second fastening sections 36 of the second legs 32 to the rear side 14*a* from the first fastening sections 26 of the first legs 22 that essentially remain in the resting position. Since excess swinging and/or rocking of the backrest 12 to the rear side 14*a* is limited, the possible load with regard to the front connection areas 34 of the chair frame is also limited.

In some embodiments, to exclude and/or minimize injury risk, the first legs 22 are in every position spaced apart in relation to the second legs 32 of the chair frame 16 such that the first and second legs 22, 32 are prevented from touch. An appropriate separation distance between the first and second legs 22, 32 may be selected in such a way that no nips of any kind are created in any position of the chair frame 16, even when the seat 10 tilts forward or the backrest 12 tilts rearward.

In some embodiments, the first and second legs 22, 32 may be separated by a minimum distance of approximately 25 mm.

While the coupling device 38 may have a maximum length (e.g., when not deformed or stretched beyond its yield point) to limit free swinging action of the seat 10 and the backrest 12 as previously described, the coupling device 38 may also have a minimum length, which may be preset by arranging and configuring the fastening elements 42, 44 and/or additional elements to a preselected length.

Figure 4:
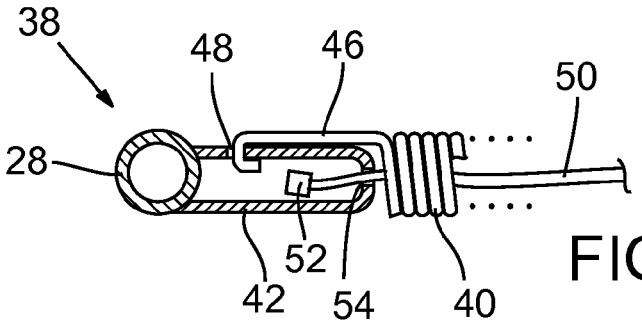
FIG. 4 is side view of the coupling device of FIG. 3.
Figure 5:
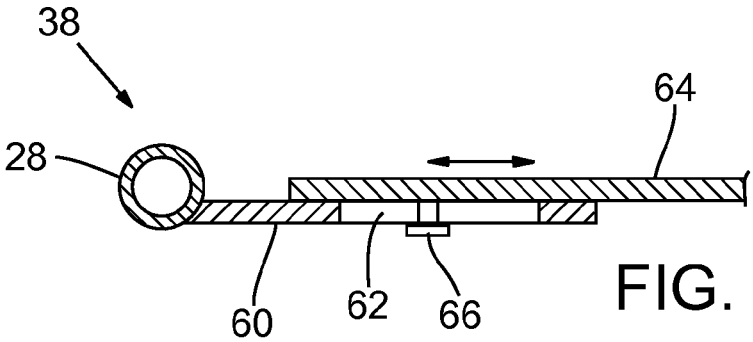
FIG. 5 is a side view of a coupling device, according to another embodiment.

FIG. 4 illustrates a view of the coupling device 38 according to one embodiment. With reference to FIG. 4, the coupling device 38 is fastened to a fastening element 42 that is mounted or rigidly attached, for example by welding, on the connection section 28. The coupling device 38 includes an elastic spring element 40, which may be in the form of a helical tension spring. This spring element 40 is configured having a hook-shaped extension 46 on its end that engages with a first opening 48 in the fastening element 42. In this configuration, the spring element 40 counteracts by its spring force any widening of the distance between the fastening elements 42, 44 and limits the distance to a maximum measure.

The coupling device 38 may also include a steel rope 50 that is routed through an axial hollow space (not shown) of the spring element 40. The steel rope 50 is routed on the end side through a second opening 54 in the fastening element 42. The steel rope 50 includes at its end a stop sleeve 52 having dimensions larger than the second opening 54 so that the stop sleeve 52 cannot pass through the second opening 54.

When the chair 100 is in its resting state, meaning without load, the steel rope 50 runs through the second opening 54 inside the fastening element 54 lying loosely in the spring element 40, whereby the steel rope 50 is in an inactive state. When a load is placed on the chair 100, such as when a user sits on the chair 100, the first and second legs 22, 32 of the chair frame 16 move, and the connection sites between the legs 22, 32 and the coupling device 38 also move apart countering the force of the spring element 40. This widening of the distance and/or elongation of the coupling device 38 may continue until a point where the stop sleeve 52 makes contact with the fastening element 42 at the end of the steel rope 50. At this point, the spring element 40 can no longer continue stretching, thereby limiting the maximum length of the coupling device 38.

In another embodiment, the coupling device 38 may include the steel rope 50, but not the spring element 40. In such embodiments, the steel rope 50 may similarly limit the maximum length of the coupling device 38 via the stop sleeve 52 abutting against the second opening 54 of the fastening element 42.

Figure 6:
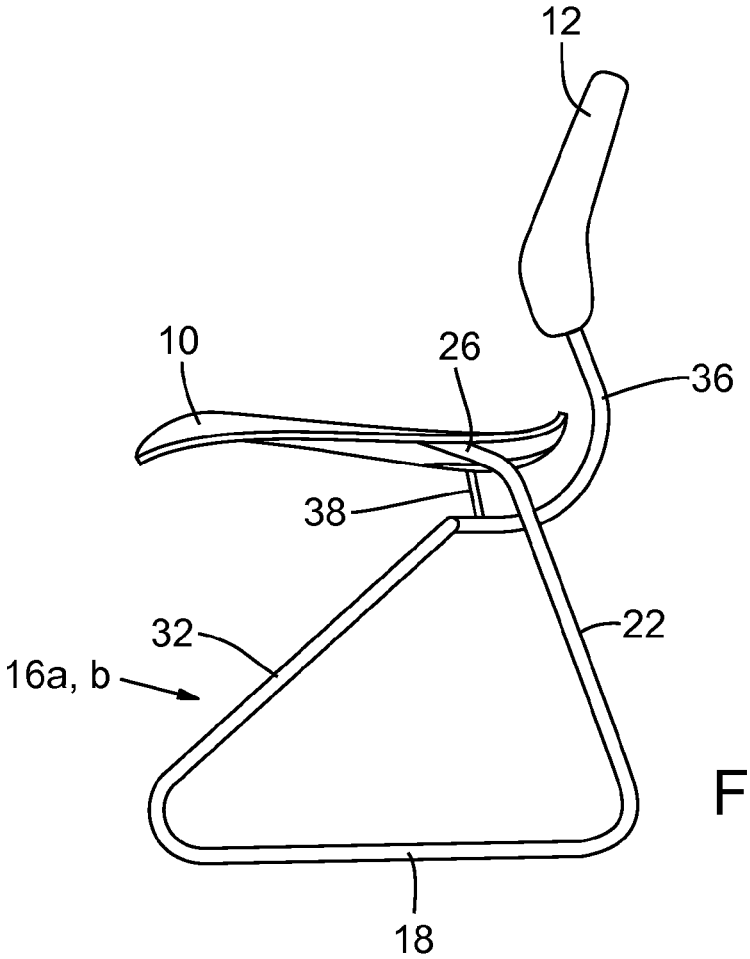
FIG. 6 is a side view of an article of seating furniture, according to another embodiment.

FIG. 6 illustrates a second arrangement of the coupling device 38 according to another embodiment. The embodiment illustrated in FIG. 6 may include identical or substantially similar components and relationships as described with reference to the embodiments illustrated in FIGS. 1-4. As such, these components will not be further discussed, except to highlight differences between the embodiments.

With reference to FIG. 6, the coupling device 38 may extend along a substantially vertical axis and substantially perpendicular in relation to the main seating direction 14 from the first connection sites on the fastening sections 26 of the first legs 22 downward to the second connection sites on the second fastening sections 36 of the second legs 32. In such embodiments, the coupling device 38 may include one spring element 40 or two parallel spring elements 40 aligned laterally offset and substantially symmetrically relative to the center axis in the main seating direction 14.

In such configurations, the first connection sites with the first legs 22 are thus located at a higher position in relation to the struts 18 as compared to the second connection sites with the second legs 32, which are located at a lower position above the struts 18.

In another embodiment, the chair 100 may include the coupling device 38 as described in FIGS. 1-4 (i.e., attached beneath the seat 10 and substantially aligned with the central axis of the main seating direction 14) and another coupling device 38 as described in FIG. 6.

In yet another embodiment, the chair 100 may include a seat 10 having a main seating direction 14, which extends from a rear side 14*a* of the seat 10 to a front side 14*b* of the seat 10. The chair 100 further includes a backrest 12 proximal to the rear side 14*a* of the seat 10. a chair frame 16 having two lateral parts 16*a*, 16*b* that each include: an essentially horizontally extending floor strut 18; a first leg 22 extending from a rear end 18*a* section of the floor strut 18 diagonally to the front and upward toward the seat 10; a first fastening section 26 disposed at an upper end section of the first leg 22 that is directed away from the floor strut 18 and configured for fastening the seat 10; a second leg 32 extending from a front end section of the floor strut 18 diagonally to the rear and upward toward the seat 10; and a second fastening section 36 disposed at an upper end section of the second leg 32 that is directed away from the floor strut 18 and configured for fastening the backrest 12; and wherein the upper end sections of the first legs 22 in the main seating direction 14 are positioned in front of the upper end sections of the second legs 32; and a longitudinally changeable coupling device 38 that is connected on one end via at least one first connection site with the first legs 22 of the two lateral parts 16*a*, 16*b* and another end via at least one second connection site with the second legs 32 of the two lateral parts 16*a*, 16*b*, wherein the coupling device 38 is configured in such a way that its maximum length is limited.

It will be obvious to those having skill in the art that many changes may be made to the details of the above-described embodiments without departing from the underlying principles of the invention. The scope of the present invention should, therefore, be determined only by the following claims.

The invention claimed is:

1. An article of seating furniture comprising:

a seat having opposing front and rear sides and oriented in a seating direction extending from the rear side of the seat toward the front side of the seat;

a backrest arranged proximal to the rear side of the seat;

a chair frame having a first component and second component laterally spaced apart, wherein each of the first and second components comprises:

a floor strut having opposing front and rear ends, the floor strut arranged parallel or substantially parallel to the seating direction;

a first leg having opposing upper and lower ends, wherein the lower end adjoins to the rear end of the floor strut, and wherein the first leg extends at an angle from the rear end of the floor strut toward the seat;

a first fastening section disposed on the upper end of the first leg and configured to be coupled to the seat;

a second leg having opposing upper and lower ends, wherein the lower end adjoins to the front end of the floor strut, and wherein the second leg extends at an angle from the front end of the floor strut toward the seat; and a second fastening section disposed on the upper end of the second leg and configured to be coupled to the backrest, wherein the upper end of the first leg is proximal to the front side of the seat and the upper end of the second leg is proximal to the rear side of the seat; and a coupling device connected on a first end via at least one first connection site with the first leg and on a second end via at least one second connection site with the second leg, wherein the coupling device is longitudinally changeable along an axis parallel to the seating direction such that the seat and the backrest move independently from one another when the coupling device extends longitudinally along the axis.

2. The article of claim 1, wherein the at least one first connection site is disposed in front of, above, or in front of and above the at least one second connection site of the coupling device.

3. The article of claim 1, wherein the coupling device includes at least one elastic spring element.

4. The article of claim 3, wherein the elastic spring element is a helical tension spring.

5. The article of claim 1, wherein the coupling device includes at least one rope on which at least one end is equipped with a stop element.

6. The article of claim 1, wherein the coupling device includes at least one elastic spring element and at least one rope on which at least one end is equipped with a stop element.

7. The article of claim 1, wherein the coupling device includes at least two rigid elements that are coupled to each other and are movable in relation to each other.

8. The article of claim 1, wherein the coupling device includes a maximum displacement, wherein the coupling device is configured and arranged such that the maximum displacement is limited.

9. The article of claim 1, wherein the first fastening sections of the first and second components of the chair frame are coupled to one another.

10. The article of claim 9, wherein the first connection site of the coupling device is disposed between a connection area of the first legs of the first and second components of the chair frame.

11. The article of claim 1, wherein the floor strut of the first component is coupled to the floor strut of the second component via at least one cross-member.

12. The article of claim 1, wherein the first and second components are laterally spaced apart in an essentially symmetrical arrangement in relation to the main seating direction.

13. The article of claim 1, wherein the first leg is spaced apart from the second leg by a minimum distance of 25 millimeters.

14. The article of claim 1, wherein the coupling device is disposed underneath the seat.

15. An article of seating furniture comprising:

a chair frame having two lateral parts that each include:

a floor strut;

a first leg extending from a rear end section of the floor strut in a diagonally upward orientation;

a first fastening section disposed at an upper end section of the first leg, wherein the upper end section is directed away from the floor strut, and wherein the first fastening section is configured to be coupled to a seat;

a second leg extending from a front end section of the floor strut in a diagonally upward orientation; and a second fastening section disposed at an upper end section of the second leg, wherein the upper end section is directed away from the floor strut and configured to be coupled to a backrest; and wherein the upper end sections of the first legs in a seating direction defined by the seat are positioned in front of the upper end sections of the second legs; and a coupling device that is connected on a first end, via at least one first connection site with the first leg of the two lateral parts and on a second end via at least one second connection site with the second leg of the two lateral parts, wherein the coupling device is longitudinally changeable along an axis parallel to the seating direction such that the seat and the backrest move independently from one another when the coupling device extends longitudinally along the axis.

16. The article of claim 15, wherein the coupling device includes at least one elastic spring element and at least one rope on which at least one end is equipped with a stop element.

17. The article of claim 15, wherein the coupling device includes a maximum displacement, wherein the coupling device is configured and arranged such that the maximum displacement is limited.

18. The article of claim 15, wherein the coupling device is disposed underneath the seat.

* * * * *